US007083385B2

(12) United States Patent
Omi

(10) Patent No.: US 7,083,385 B2
(45) Date of Patent: Aug. 1, 2006

(54) AXIAL FLOW FAN MOTOR

(75) Inventor: Kenji Omi, Nagano-Ken (JP)

(73) Assignee: Minebea Co., Ltd., Nagano (JP)

( * ) Notice: Subject to any disclaimer, the term of this patent is extended or adjusted under 35 U.S.C. 154(b) by 94 days.

(21) Appl. No.: 10/899,241

(22) Filed: Jul. 26, 2004

(65) Prior Publication Data

US 2005/0058544 A1 Mar. 17, 2005

(30) Foreign Application Priority Data

Jul. 25, 2003 (JP) ..... 2003-280073

(51) Int. Cl.
*F04D 29/054* (2006.01)
*F04D 29/063* (2006.01)
*F04D 29/64* (2006.01)

(52) U.S. Cl. ..... 416/174; 416/244 R; 415/220; 415/229; 415/230; 415/216.1; 417/354; 417/423.11; 417/423.12; 417/423.13; 310/90; 384/481; 384/488; 384/537; 384/902; 29/446; 29/450; 29/453; 29/898.07; 29/898.09

(58) Field of Classification Search ..... 416/174, 416/204 R, 206, 244 R; 415/220, 222, 216.1, 415/229, 230; 417/354, 423.11, 423.12, 417/423.13, 423.1; 310/67 R, 90; 384/477, 384/481, 488, 537, 902; 29/446, 450, 453, 29/898.07, 898.09
See application file for complete search history.

(56) References Cited

U.S. PATENT DOCUMENTS

| | | | | |
|---|---|---|---|---|
| 3,513,339 | A * | 5/1970 | Harris et al. | 310/90 |
| 3,644,066 | A * | 2/1972 | Heob et al. | 417/354 |
| 5,028,216 | A * | 7/1991 | Harmsen et al. | 417/354 |
| 5,441,386 | A * | 8/1995 | Hsieh | 415/230 |
| 6,196,802 | B1 * | 3/2001 | Matsumoto | 416/244 R |
| 6,420,809 | B1 * | 7/2002 | Obara | 310/90 |

* cited by examiner

*Primary Examiner*—Christopher Verdier
(74) *Attorney, Agent, or Firm*—Joel E. Lutzker, Esq.; Anna Vishev, Esq.; Schulte Roth & Zabel LLP

(57) ABSTRACT

An axial flow fan motor having an impeller molded integrally with a shaft from a synthetic resin. The shaft is easily assembled with a bearing arrangement by being brought into tight contact with the inner ring of the bearing arrangement and is reliably fixed thereto in the elastic region of the shaft. A through hole is formed in the shaft along its central axis. After the shaft is fit into the inner ring of the bearing arrangement, a metal pin is pressed into the axial through hole. Because the pin is pressed in, the shaft is elastically expanded and brought into tight contact with the inner ring and fixed thereto in the elastic region of the shaft. Furthermore, the distal end portion of the shaft elastically outwardly expands and is pressed against the end surface of the inner ring, thereby preventing the bearing arrangement from coming off the shaft.

9 Claims, 5 Drawing Sheets

AXIAL FLOW FAN MOTOR

CROSS-REFERENCE TO RELATED APPLICATIONS

This application claims all rights of priority to Japanese Patent Application Serial No. 2003-280073, filed Jul. 25, 2003 (pending).

FIELD OF THE INVENTION

The present invention relates to an axial flow fan motor used for cooling electronic devices and the like.

BACKGROUND

Small axial flow fan motors have been installed in electronic devices such as personal computers, servers, and copiers for cooling casings or for cooling individual electronic components.

An example of an axial flow fan motor of this type was described in Japanese Unexamined Utility Model Application No. H7-36573 (hereinafter "Patent Reference 1"). In this motor, as shown in FIG. 6, a shaft 106 of an impeller 109 made from a synthetic resin and having a plurality of fans 111 is rotatably supported by bearings 104 and 105 in a bearing box 103 of a casing 101 forming an inner tubular venturi portion 102. A stator 120, composed of a core 117, a coil 118, and an insulator 119, and a PC board (printed circuit board) 115 having drive circuits for the motor mounted thereon are installed at an outer side of the bearing box, while a rotor composed of a yoke 113 and a magnet 114 is installed at the impeller side in an opposing relationship with the stator.

If an electric current is passed to the drive circuits, the stator 120 generates a magnetic field, a rotary force acts upon the rotor, the impeller 109 rotates, and a unidirectional airflow is generated inside the venturi portion 102 of the casing 101.

Furthermore, as described in Patent Reference 1, the impeller 109 and the shaft 106 thereof are formed integrally from synthetic resin in order to reduce cost by reducing the number of parts and assembly operations.

However, in the motor described in Patent Reference 1, the strength of the shaft 106, which is molded from a synthetic resin integrally with the impeller 109, is weak compared with that of metal shafts. For this reason, Japanese Utility Model Registration No. 3028698 (hereinafter "Patent Reference 2") described an axial flow fan motor, as shown in FIG. 7, in which, the reinforcement was made by installing a metal rod 221 inside the shaft portion 206A during molding of the shaft-integrated impeller 209 from a synthetic resin to increase the strength of the shaft 106.

However, in the axial flow fan motor described in Patent Reference 2, in order to install the metal rod 221 inside the shaft portion 206A, it is necessary to set the metal rod 221 in the cavity of the molding die to form the shaft-integrated impeller 209. This molding operation is more difficult than the operation of molding the shaft-integrated impeller 109 described in Patent Reference 1.

Furthermore, it was preferred in both in the axial flow fan motors described in Patent Reference 1 and in Patent Reference 2, that tight contact be maintained and the components be fixed by press fitting into the inner rings of rolling bearings 104 (204), 105 (205) by making use of the elastic properties of the shaft formed from a synthetic resin. (In such a case, the adhesive is not required and the motor can be assembled and disassembled). However, taking into account the difficulty of press fitting and possible damage of rolling bearings at the time of press fitting, the aforesaid press fitting was avoided and the shaft and inner rings of rolling bearings 104 (204), 105 (205) were fixed by employing clearance fitting and using a locking ring 107 (207).

SUMMARY OF THE INVENTION

The present invention addresses the problems inherent to the axial flow fan motors described in Patent Reference 1 and Patent Reference 2, and it is an object of the present invention to provide an axial flow fan motor in which, in order to reduce cost, the shaft and the inner rings of the rolling bearings are brought into tight contact with one another and fixed by making use of elastic properties of synthetic resin. Damage of rolling bearings is prevented and assembly is facilitated by employing clearance fitting during assembling.

In order to resolve the above-described problems, the present invention provides an axial flow fan motor in which an impeller and a shaft having a through hole formed along the shaft axis thereof are molded integrally from a synthetic resin. The shaft of the impeller is rotatably supported with the bearings fixed to the case side in that the shaft is fitted into the inner rings of the bearings. By pressing a pin in the through hole formed along the shaft axis, the shaft is elastically expanded and brought into tight contact with at least one of the inner rings.

In another aspect of the axial flow fan motor of the invention, the shaft is brought into contact with the end surface of the inner rings and locked in place when the distal end portion of the shaft is elastically expanded by the insertion of the pin.

In a further aspect of the invention, the bearings of the axial flow fan motor are composed of a rolling bearing and a sliding bearing, where the sliding bearing includes the inner ring of the rolling bearing. An oil-impregnated sintered metal slides over the outer peripheral surface of the inner ring, and together with the rolling bearing rotatably supports the shaft.

In the axial flow fan motor in accordance with the invention, the shaft is fitted into the inner rings of the bearings, and then a pin is pressed into the through hole formed along the axis of the shaft. As a result, the outer peripheral surface of the shaft is elastically expanded and brought into tight contact with the inner peripheral surface of the inner rings of the bearings. Therefore, the shaft and the inner rings of the bearings can be fixed to each other, and the insufficient rigidity and insufficient strength of the synthetic resin having appropriate elastic properties can be compensated for by inserting the pin.

Further, with the axial flow fan motor in accordance with the present invention, the bearings can be prevented from coming off the shaft by elastically expanding the distal end portion of the shaft and bringing it into contact with the end surface of the inner ring by means of inserting the pin into the through hole formed along the shaft axis.

Moreover, with the axial flow fan motor in accordance with the present invention, the bearings are preferably composed of a rolling bearing and a sliding bearing, where the sliding bearing is disposed on the inner ring of the rolling bearing. An oil-impregnated sintered metal slide slides over the outer peripheral surface of the inner ring, and together with the rolling bearing rotatably supports the shaft. As a result, the size of the motor in the axial direction can be greatly reduced by comparison with that of the conventional motors that use two rolling bearings. Moreover, using an assembly of a standard rolling bearing and an oil-impregnated sintered metal makes it unnecessary to use a special rolling bearing thus reducing the cost of parts.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of example and not limitation and the figures of the accompanying drawings in which like references denote like or corresponding parts, and in which.

DETAILED DESCRIPTION OF THE PREFERRED EMBODIMENT AND THE DRAWINGS

The preferred embodiment of the present invention will be described hereinbelow in greater detail with reference to the appended drawings.

Figure 3:
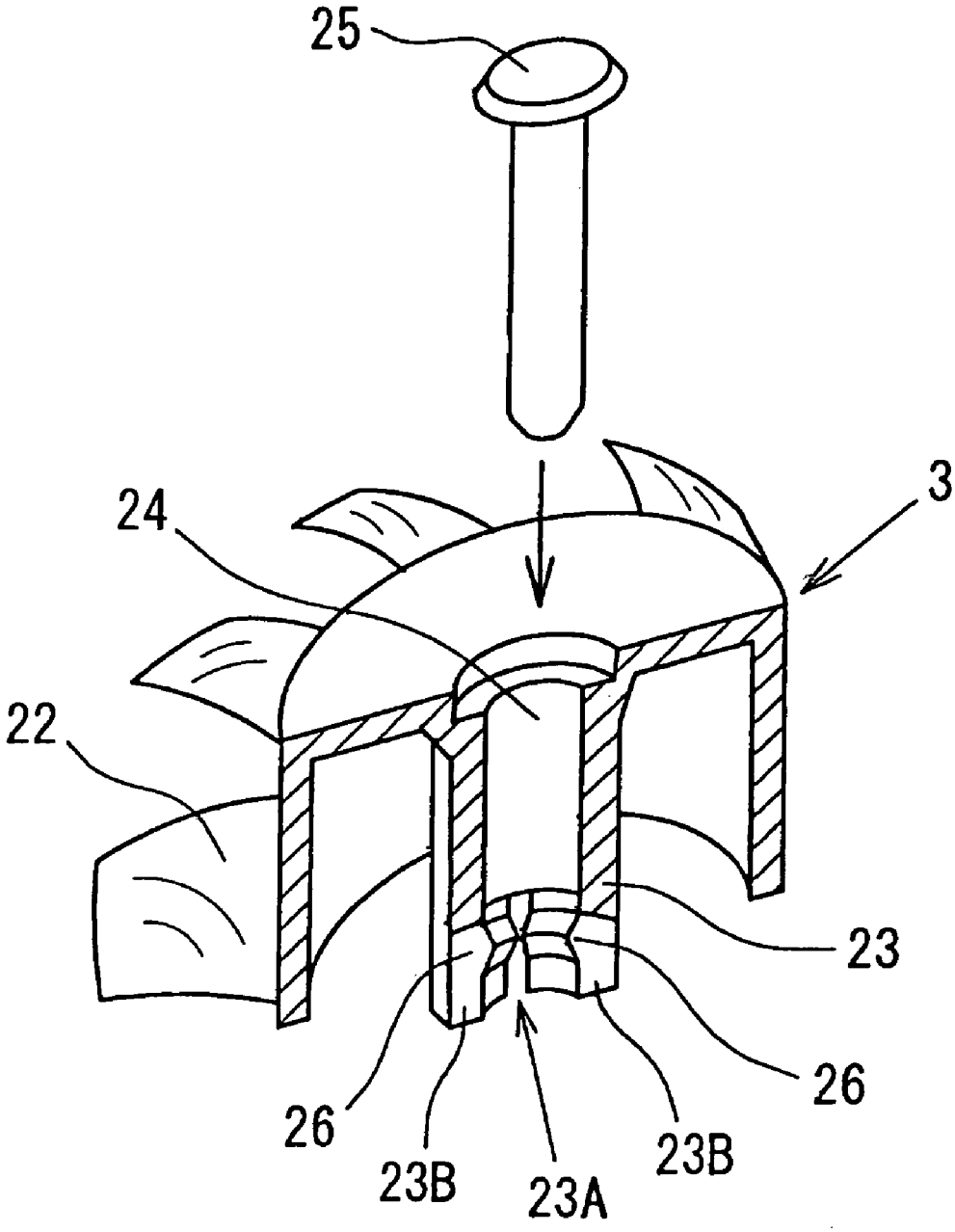
FIG. 3 is a sectional perspective view of the impeller of the axial flow fan motor shown in FIG. 1.

As shown in FIG. 3, an impeller 3 and a shaft 23 are molded integrally from a synthetic resin. A through hole 24 is formed in the shaft 23 along the axis thereof for inserting a pin 25 into this through hole 24.

Figure 4:
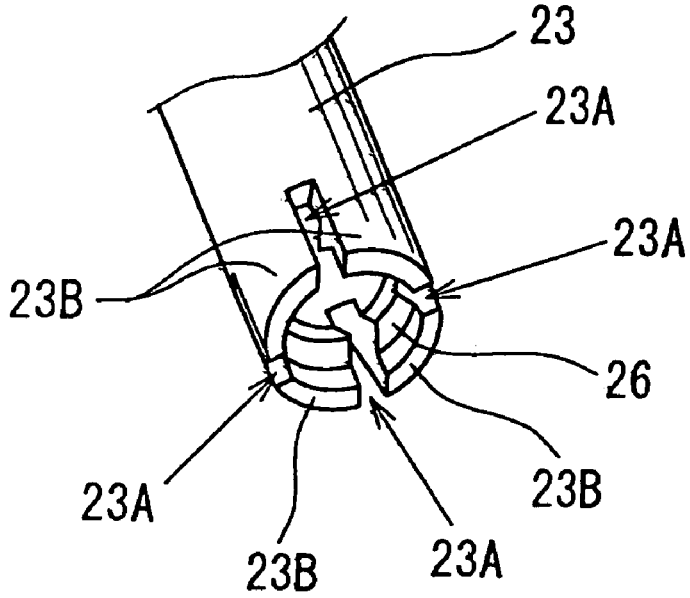
FIG. 4 is a perspective view of the main part of the distal end portion of the impeller shaft shown in FIG. 3.

The distal end portion of the shaft 23, as shown in FIG. 4, is split into a plurality of sections 23B by a plurality of notches 23A extending in the axial direction on the circumferential wall of the shaft 23 (in FIG. 4, division into 4 sections is shown). A protruding portion 26 is formed on the inner surface of each split section 23B so as to protrude inwardly (the inner diameter thereof is somewhat smaller than the inner diameter of the through hole 24) from the inner peripheral surface of the through hole 24. This protruding portion 26 is employed to elastically outwardly expand the split sections 23B and to bring them into contact with the inner surface of the inner ring when the pin 25 is inserted into the through hole 24.

Figure 1:
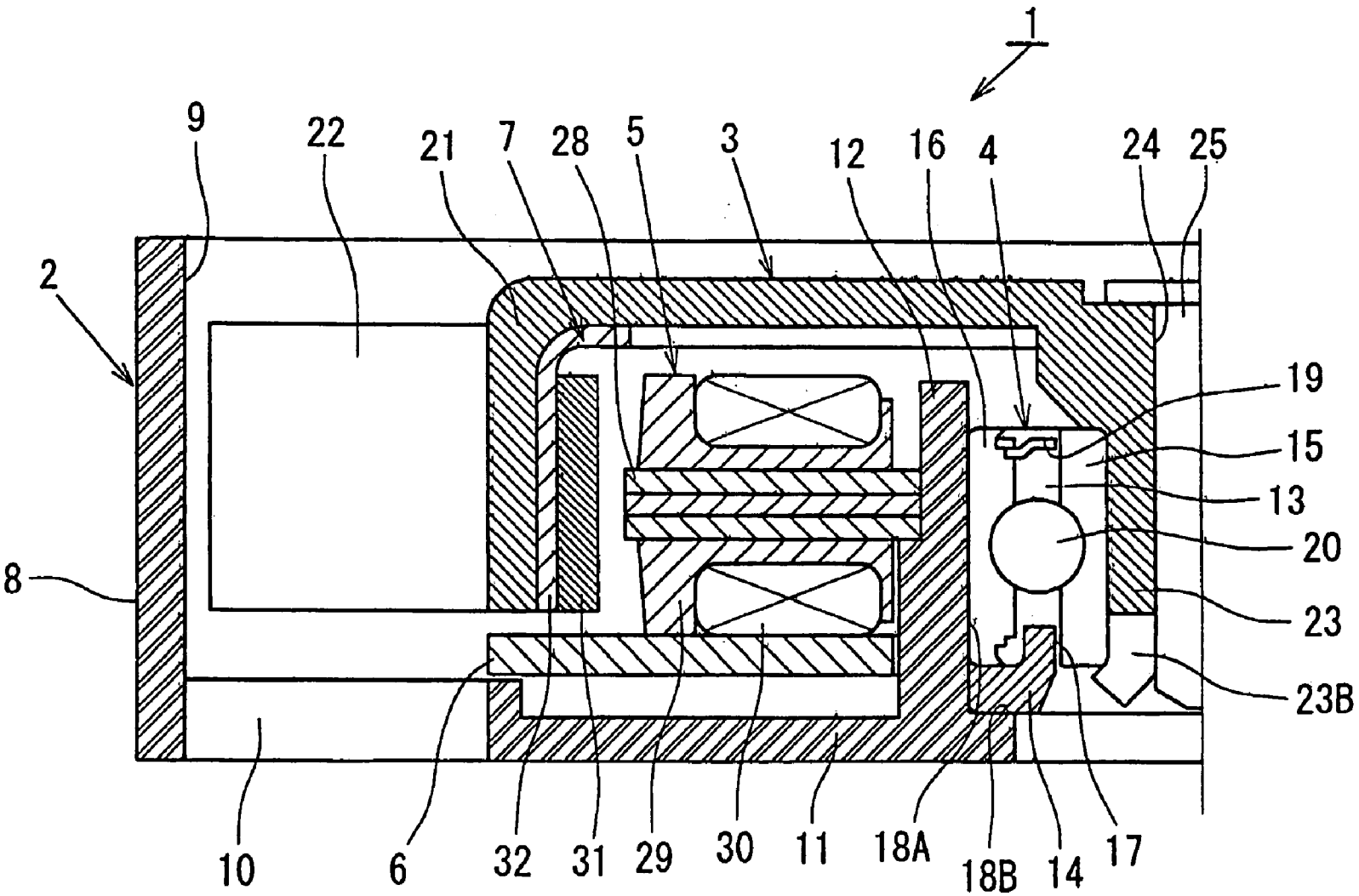
FIG. 1 is a longitudinal sectional view of the axial flow fan motor of an embodiment of the present invention.

Further, as shown in FIG. 1, the outer ring 16 of the rolling bearing 13 and the oil-impregnated sintered metal slide 14, also functioning as the outer ring of the sliding bearing, are press, fitted and fixed to the bearing housing 12 of a base portion 11. The sliding bearing surface 17 of the oil-impregnated sintered metal slide 14 slides along the outer peripheral surface of the inner ring 15 of the rolling bearing 13 and functions as the sliding bearing. The outer peripheral surface and lower end surface of the oil-impregnated sintered metal slide 14 are supported by the inner peripheral surface 18A of the bearing housing 12 and a flange top portion 18B, respectively. Furthermore, the oil-impregnated sintered metal slide 14 supports the lower end surface of the outer ring 16 of the rolling bearing 13.

Because the outer peripheral surface of the inner ring 15 of the rolling bearing 13 has been super-finished, sliding of the oil-impregnated sintered metal slide, 14 over the sliding bearing surface 17 proceeds extremely smoothly, and high-performance bearing characteristics (rotation accuracy and the like) can be obtained.

In a standard rolling bearing, a shield 19 is attached at both ends. However, when such a standard rolling bearing is used for implementing the present invention, the shield is not installed at one side, and the oil-impregnated sintered metal slide 14 is inserted between the inner ring 15 and outer ring 16 of the rolling bearing 13. As a result, a sliding bearing function is provided, and the oil-impregnated sintered metal slide 14 also functions as a shield.

The rotor 7 is composed of a ring-like permanent magnet 31 and a yoke 32 for supporting the magnet and is fixed to the inner peripheral portion of the boss 21 of the impeller 3. The permanent magnet 31 of the rotor 7 and the core 28 of the stator 5 are disposed in an opposing relationship with a prescribed clearance in the radial direction. Because the permanent magnet 31 and the core 28 of the stator 5 are disposed with a shift in the axial direction from the magnet center of the permanent magnet 31 of rotor 7 and the core 28 of stator 5, a magnetic attraction force acts between the permanent magnet 31 and core 28 in the rolling bearing 13, thus applying a preliminary pressure.

In the axial flow fan motor of an embodiment of the present invention where the pin 25 has been inserted into the through hole 24 of the shaft 23, as shown in FIG. 1, the outer peripheral surface of the shaft 23 made from a synthetic resin is elastically expanded and brought into a tight contact with the inner peripheral surface of the inner ring 15 of the bearing arrangement 4 in this elastic region, thereby fixing the shaft 23 to the inner ring 15 of the bearing arrangement 4.

Further, split sections 23B at the distal end of the shaft 23 elastically expand and are pressed against the end surface of the inner ring 15. As a result, the bearing arrangement 4 is reliably prevented from coming off the shaft 23.

Figure 2:
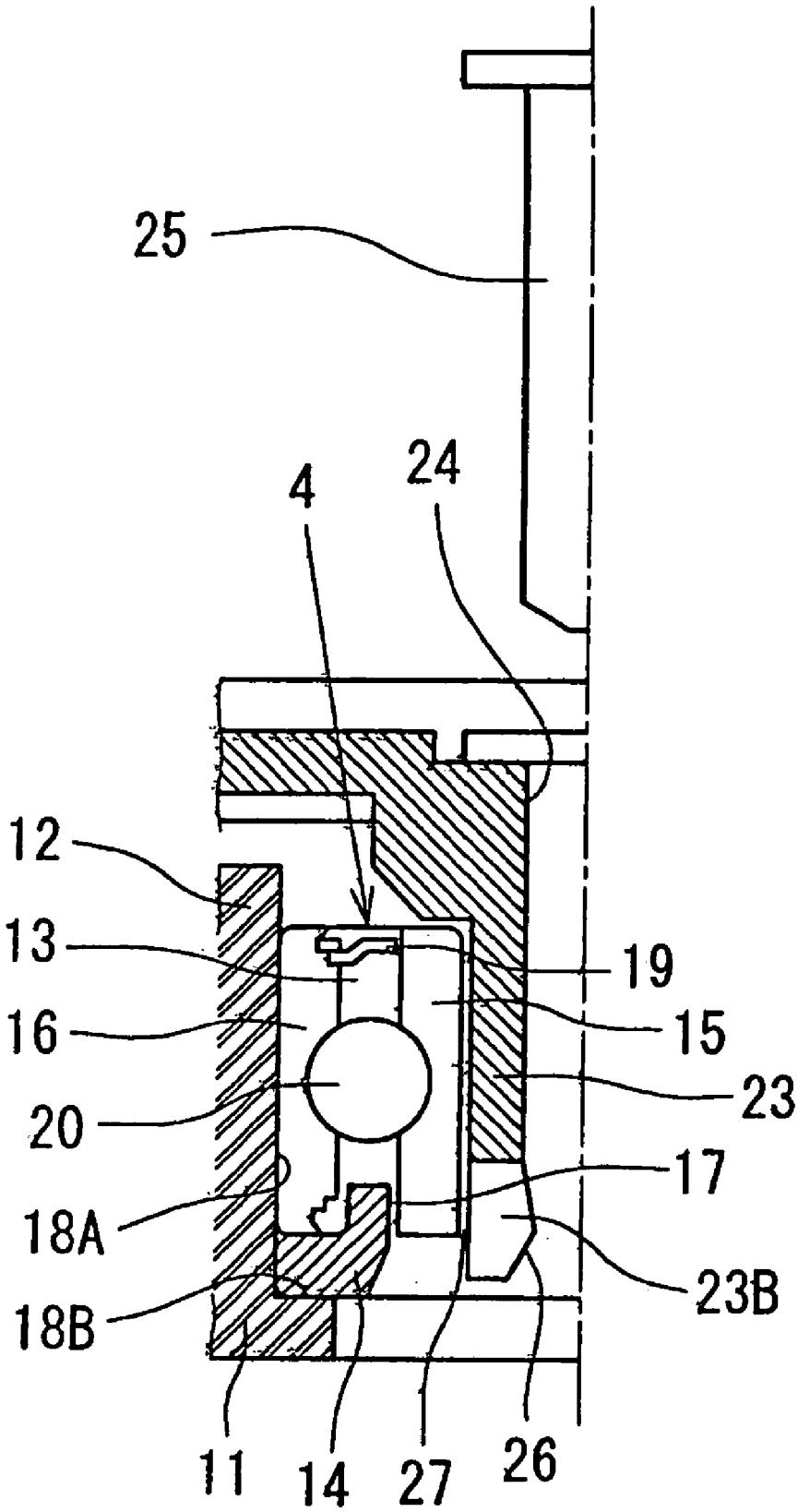
FIG. 2 is an exploded view illustrating the shaft portion of the impeller prior to pin insertion in the axial flow fan motor shown in FIG. 1.

The process for assembling the axial flow fan motor 1 will be described below. As shown in FIG. 2, the oil-impregnated sintered metal slide 14 and the outer ring 16 of the rolling bearing 13 are inserted in and secured to the inner peripheral surface 18A of the bearing housing 12. In the present assembly, the inner ring 15 of the rolling bearing 13 can move slightly in the radial and axial directions. Therefore, the inner ring 15 can be inserted easily onto the sliding bearing surface 17 of the oil-impregnated sintered metal slide 14. The rotor 7 is assembled by fitting the shaft 23 into the inner ring 15 of the rolling bearing 13. In this process, the shaft 23 is fitted into the inner ring 15, forming a clearance gap 27. As described above, the shaft 23 is formed with the through hole 24 along its central axis. The inner diameter of the unexpanded shaft may be slightly smaller than the outer diameter of the pin 25. When the pin 25 is pressed into the through hole 24, the outer peripheral surface of the shaft 23 is elastically expanded and brought into a tight contact with the inner peripheral surface of the inner ring 15, thereby making it possible to secure the shaft 23 to the inner ring 15. The clearance gap 27 is thus eliminated.

Because the shaft 23 is fitted into the inner ring 15 of the bearing arrangement 4 with the clearance gap 27, damage of the bearing arrangement 4 during assembly can be prevented. When the pin 25 is thereafter pressed into the through hole 24, the shaft 23 is reliably secured to the inner ring 15 through the elastic radial expansion of the outer peripheral surface of the shaft 23. This elastic radial expansion facilitates a tight contact between the inner peripheral surface of the inner ring 15 of the bearing arrangement 4 and the outer surface of the shaft 23 along the elastic region of the shaft.

Furthermore, no additional means, for example, a separate part such as a snap ring, is needed to prevent the shaft 23 from coming off because the split sections 23B expand elastically outwardly and are pressed against the lower end surface of the inner ring 15 via the protrusions 26, when the pin 25 is inserted.

In accordance with the present invention, the axial size of the motor is significantly reduced as compared to the axial size of a conventional motor. This advantage is accomplished by supporting the shaft 23 with the bearing arrangement 4 having the rolling bearing 13 and the oil-impregnated sintered metal slide 14 functioning as the outer ring of the sliding bearing. The invention miniaturizes the structure, and reduces the cost of parts. Furthermore, because a standard rolling bearing can be used as bearing 13 in combination with the oil-impregnated sintered metal slide 14, no special rolling bearing is required, eliminating the cost of such specialized parts. Moreover, the oil-impregnated sintered metal slide 14 is incorporated into the rolling bearing 13 and functions as a sliding bearing in which the sliding bearing surface 17 slides over the outer peripheral surface of the inner ring 15 of the same rolling bearing 13. Additionally, the oil-impregnated sintered metal 14 also functions as a bearing shield.

Figure 5:
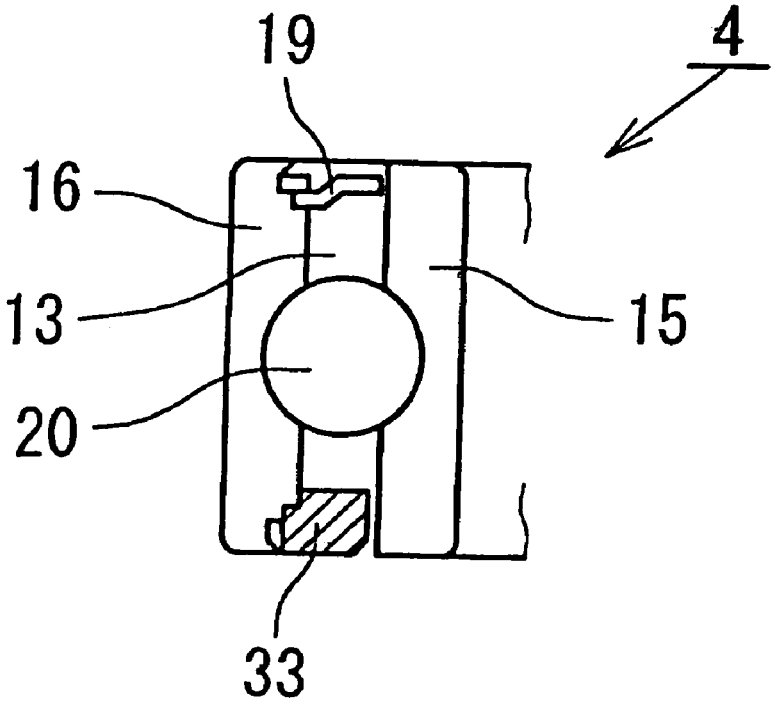
FIG. 5 is a longitudinal sectional view of the main part illustrating the modified example of the bearing in the axial flow fan motor shown in FIG. 1.
Figure 6:
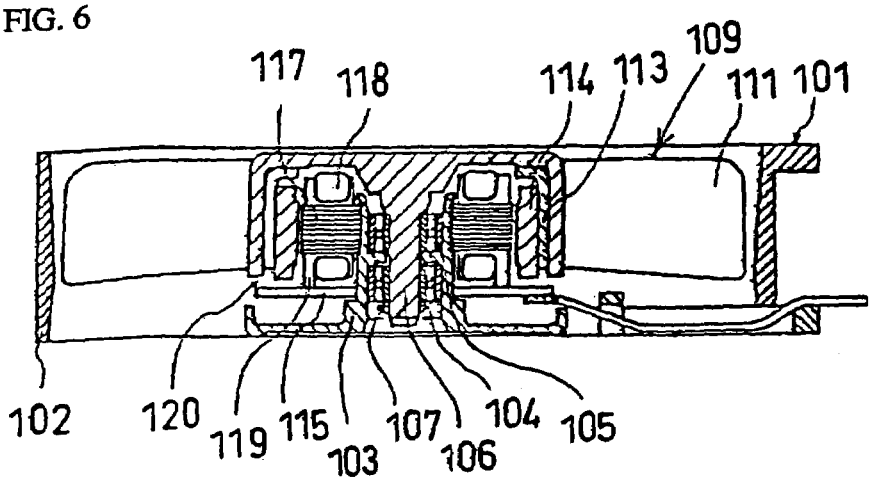
FIG. 6 is a longitudinal sectional view of the conventional axial flow fan motor.
Figure 7:
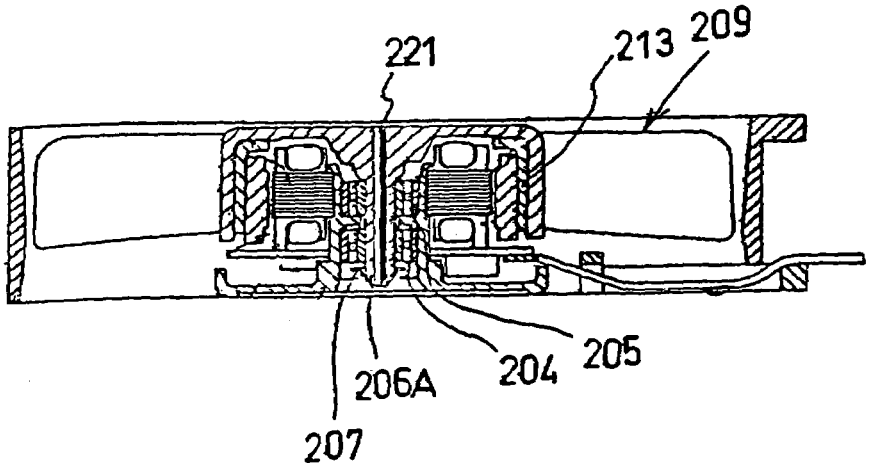
FIG. 7 is a longitudinal sectional view of another conventional axial flow fan motor.

A bearing arrangement 4 shown in FIG. 5 can be used as another example of the above-described preferred embodiment. In the bearing arrangement 4 shown in FIG. 5, an oil-impregnated sintered metal slide 33 is fully incorporated into the rolling bearing 13. The outer peripheral surface of the oil-impregnated sintered metal slide 33 slides over the outer peripheral surface of the inner ring 15, and the other side of the slide 33 is pressed to the inner peripheral surface of the outer ring 16. As a result, the size of the entire bearing arrangement in the axial direction becomes equal to the size of the rolling bearing 13 in the axial direction. Therefore, the axial flow fan motor 1 can be further miniaturized. In FIG. 5, parts identical to those shown in FIG. 1 are denoted by the same symbols.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Other undescribed variations or modifications may be possible. For example, where multiple alternative embodiments are described, in many cases it will be possible to combine elements of different embodiments, or to combine elements of the embodiments described here with other modifications or variations that are not expressly described. Many of those undescribed variations, modifications and variations are within the literal scope of the following claims, and others are equivalent.

I claim:

1. An axial flow fan motor comprising:

an impeller further comprising a shaft having an inner axial through hole, said impeller and said shaft being integrally molded from the same elastic material;

a bearing arrangement rotatably supporting said shaft and having at least one inner ring; and a pin being inserted into said inner axial through hole of said shaft, wherein said pin inserted into said inner axial through hole expands said shaft in a radial direction securely fixing said at least one inner ring of said bearing arrangement to said shaft.

2. The axial fan motor according to claim 1, wherein said shaft further comprises a distal end, said distal end being configured to expand outwardly when said pin is inserted into said inner axial through hole and to prevent said at least one inner ring from sliding off said shaft.

3. The axial fan motor according to claim 2, wherein said distal end of said shaft further comprises a plurality of split sections, each of said split sections having a protruding portion located on the inner surface of said split section.

4. The axial fan motor according to claim 3, wherein an inner diameter of said distal end along said protruding portion is smaller than an inner diameter of said inner axial through hole.

5. The axial fan motor according to claim 1, wherein said bearing arrangement further comprises a rolling bearing and a sliding bearing, said sliding bearing and said rolling bearing having the same inner ring.

6. The axial fan motor according to claim 5, wherein said sliding bearing further comprises an oil-impregnated sintered metal slide, said slide being configured to slide along said inner ring.

7. The axial fan motor according to claim 6, wherein said rolling bearing further comprises an outer ring, wherein said motor further comprises a bearing housing, and wherein said outer ring of said rolling bearing and said oil-impregnated sintered metal slide are secured to an inner surface of said bearing housing.

8. The axial fan motor according to claim 6, wherein said rolling bearing further comprises an outer ring, and wherein said oil-impregnated sintered metal slide is secured to said outer ring of said rolling bearing.

9. The axial fan motor according to claim 1, wherein said elastic material is synthetic resin.

* * * * *